United States Patent [19]

Benecke et al.

[11] Patent Number: 4,642,135

[45] Date of Patent: Feb. 10, 1987

[54] PROCESS FOR TREATING CAST IRON MELTS WITH SILICON CARBIDE

[75] Inventors: Theodor Benecke, Munich, Fed. Rep. of Germany; Benno Lux, Vienna, Austria; Wolf-Dieter Schubert, Vienna, Austria; An Tuan Ta, Vienna, Austria; Gerhard Kahr, Vienna, Austria

[73] Assignee: Elektroschmelzwerk Kempten GmbH, Munich, Fed. Rep. of Germany

[21] Appl. No.: 766,635

[22] Filed: Aug. 16, 1985

[30] Foreign Application Priority Data

Aug. 24, 1984 [DE] Fed. Rep. of Germany ..... 3431263

[51] Int. Cl.[4] ..... C21C 7/02

[52] U.S. Cl. ..... 420/33; 75/53; 75/58

[58] Field of Search ..... 75/53, 58, 130 R

[56] References Cited

U.S. PATENT DOCUMENTS

| | | | |
|---|---|---|---|
| 2,569,146 | 9/1951 | Balkcom | 75/58 |
| 2,771,356 | 11/1956 | Carlson | 75/58 |
| 3,051,564 | 8/1962 | Drenning | 75/58 |
| 3,158,465 | 11/1964 | Brown | 75/58 |

*Primary Examiner*—Peter D. Rosenberg

*Attorney, Agent, or Firm*—Burgess, Ryan & Wayne

[57] ABSTRACT

The invention relates to a process for treating cast iron melts with silicon carbide. In this process, the silicon carbide used is subjected, before being introduced into the cast iron melt, to an oxidizing treatment in such a manner that the individual SiC granules are coated with a covering containing silica. A silicon carbide of this quality can be manufactured, for example, by subjecting the SiC in granular form, in a static or agitated mass, to an oxidizing atmosphere, such as air, oxygen or water vapor, at temperatures within the range of 900°–1600° C. and subsequently subjecting the agglomerates formed to gentle comminution to expose the SiC surfaces which, as a result of the formation of an agglomerate, completely or partially escaped the oxidizing attack.

8 Claims, 3 Drawing Figures

PROCESS FOR TREATING CAST IRON MELTS WITH SILICON CARBIDE

FIELD OF THE INVENTION

This invention relates to a process for treating cast iron melts with silicon carbide.

BACKGROUND OF THE INVENTION

The use of silicon carbide for treating cast iron melts, such as for siliconizing, carburizing, deoxidizing and inoculating, has long formed part of the prior art (see U.S. Pat. No. 2,020,171, DE-C-2215266 and DE-A-2746478).

For this purpose there is customarily used so-called metallurgical silicon carbide which has a SiC content varying within the range of approximately 85–95% by weight, which still contains, as a result of the manufacturing process, approximately 2–5% by weight of free carbon and approximately 2–3% by weight of silica and which is commercially available in the form of granules within the range of up to 20 mm and having a maximum grain distribution of <10 mm.

The use of metallurgical silicon carbide as an alloying agent has a positive influence on the quality of the cast iron since, during the siliconizing step, a preliminary inoculation of the melt occurs and the effect of this preliminary inoculation disappears only slowly. It manifests itself in a slight super-cooling of the melt, an increase in the number of eutectic granules, a favorable distribution and formation of the graphite and a reduced tendency to white hardening and an increased tendency to grey hardening. This results in an increase of the tensile strength:hardness relationship producing better mechanical properties, machineability and general homogenity throughout the casting (see investigations of K. H. Caspers in "Giesserei" (Foundry), Vol. 59 (1972), pp 556–559 and the summarizing article to Th. Benecke in "Giesserei" (Foundry), Vol. 68 (1981), pp 344–349).

Virtually nothing is known about the causes of the inoculating effect of metallurgical silicon carbide and its long-term effect. From the comparative studies of R. L. Doelmann, et al in "Giesserei-Praxis" (Foundry Practice), No. 12 (1981), pp 205–212, it seems that with 80% silicon carbide, a cast iron can be produced having better properties than that produced with 90% silicon carbide, which the authors attempt to associate with the higher carbon content (7.2%) in the form of graphite and thermally treated petroleum coke in the 80% silicon carbide.

This does not, however, permit the specific selection of particular types of metallurgical SiC which produce, each time, in a reproducible manner, the same results under the same smelting conditions, since the individual factors which are responsible, when SiC is used, for the formation of nuclei in the melt are still unknown.

The problem is, therefore, to select a silicon carbide for the treatment of cast iron melts that is of such a type that it is able specifically to control the formation of nuclei in the cast iron melt, without it being necessary, for this purpose, to carry out an expensive preliminary assessment of commercial metallurgical SiC qualities, each of which, as a result of the manufacturing process, contains different amounts of accompanying materials.

SUMMARY OF THE INVENTION

This problem is solved according to the invention by using a SiC which, before being introduced into the cast iron melt, is subjected to an oxidizing treatment in such a manner that the individual silicon carbide granules are partially coated with a covering containing silica and at the same time, the granules agglomerate. Thereafter, the agglomerates are comminuted leaving the granules with silicon carbide surfaces there where the individual granules had touched one another.

It is critical for the silicon carbide to be used according to the invention that the individual SiC granules are not completely coated with a uniformly thick layer containing silica, but that this layer is broken at certain places on the surface of the granules, that is to say, at these places is either completely missing or only very thin. This can be achieved, for example, by subjecting a silicon carbide in granular form in a static or agitated mass to an oxidizing atmosphere, such as air, oxygen or water vapor, at temperatures within the range of 900°–1600° C. The individual granules are oxidized at the free surfaces, a layer of $SiO_2$ being formed, and at the same time, the granules are agglomerated. The agglomerates are then subjected to gentle comminution to expose the silicon carbide surfaces which, as a result of the formation of an agglomerate, completely or partially escaped the oxidizing attack.

DESCRIPTION OF THE DRAWINGS

The invention will more readily be understood by reference to the drawings, wherein.

DETAILED DESCRIPTION OF THE INVENTION

Figure 1:
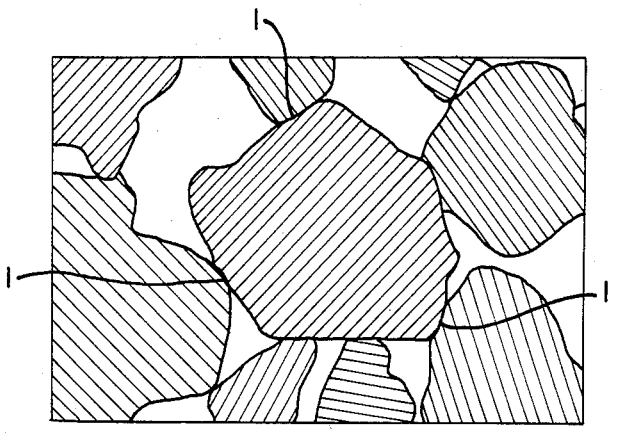
FIG. 1*a* is a cross-sectional, enlarged drawing of SiC granules depicting the individual granules in contact at points 1 with one another prior to oxidation.
FIG. 1*b* is a cross-sectional, enlarged drawing of SiC granules depicting the same granules after oxidation and production of the $SiO_2$ layer at 2.
FIG. 1*c* is a cross-sectional, enlarged drawing of a single SiC granule taken from the center of FIG. 1*a* after comminution of the aggragate and showing the $SiO_2$ layer 2 which is interrupted by exposed surfaces at areas 3.
Figure 2:
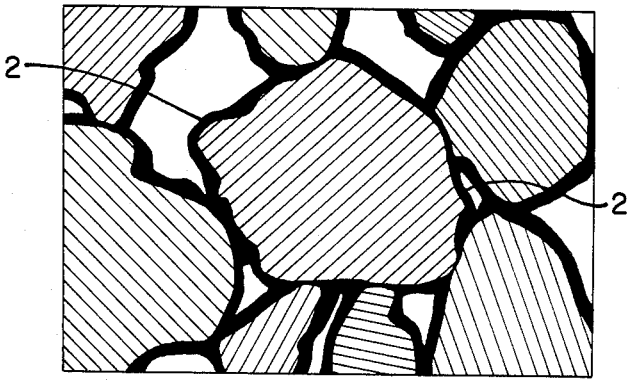
Figure 3:
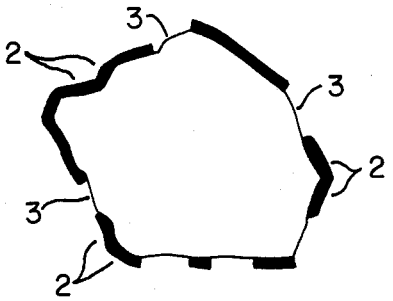

According to a preferred embodiment of the invention, a silicon carbide having grain sizes of 0.5 mm and finer, especially within the range of from 0.1 to 0.5 mm, an a SiC content of at least 95% by weight is subjected, in a static mass, to an oxidizing treatment using air currents at temperatures of 1250°–1300° C. In these conditions and depending on the time, layer thicknesses of the covering containing the silica of up to approximately 15 μm, especially within the range of from 0.5 μm to 5 μm, can be produced. During this process, the degree of oxidation can be determined from the decrease in the original SiC content. The subsequent comminution under gentle conditions can be carried out, for example, in a mortar. In this case, gentle conditions are to be understood as meaning that the agglomerated granules are only separated; not that the granules themselves are further comminuted, so that the grain size originally used remains virtually unchanged. As a result of this specific preliminary treatment, a silicon carbide of a precisely defined quality is obtained; its inoculating action, which has a long-term effect, was demonstrated in cast iron melts having different degrees of saturation, as is explained in detail in the following examples. There are used as cast iron melts those of high purity that naturally have an especially low nuclei content.

The process according to the invention is not, however, limited to this preferred embodiment; on the contrary, it falls within the scope of the invention that the parameters both for the oxidizing treatment and for the silicon carbide which is subjected to this treatment can be varied within a broad range.

The silicon carbide pre-treated according to the invention can be introduced into the cast iron melt in the customary known manner, such as by addition to the melt aggregate, in and before the heat-holding aggregate or in the fore-hearth or by addition to the charge before smelting. In addition, it can be used both in the form of loose granules and in the form of pellets or briquettes which have been compressed in customary known manner.

EXAMPLE 1

Manufacture of a pre-treated silicon carbide:

There was used as starting material, crystalline silicon carbide having a SiC content of 98.5% by weight, a $SiO_2$ content of 0.26% by weight and a grain size of 0.1–0.5 mm which has been freshly milled and screened.

This SiC was introduced, in the form of a loose mass, into an electrically heated tubular furnace and oxidized for 72 hours at 1250°–1300° C. under a slight partial vacuum (0.4–0.6 bar) in an atmosphere of flowing air. After cooling, the agglomerated product was removed from the furnace and comminuted by gentle breaking in a mortar.

After oxidation, the SiC content was 93.9% by weight and the $SiO_2$ content was 4.6% by weight. The degree of oxidation, that is to say the percentage of oxidized SiC, calculated from the decrease in the SiC content and corresponding to the increase in the $SiO_2$ content, was therefore 3%. The maximum layer thickness of the $SiO_2$ covering was 5 μm.

EXAMPLE 2

Use of the silicon carbide pre-treated according to Example 1 for preliminary inoculation of cast iron melts in comparison with untreated SiC:

In each case, the melt contained 2% by weight of Si.

Addition of the Si-carrier either with the cold charge or by stirring in at 1350° C.

Unless otherwise indicated, degree of saturation (Sc) of the melt=0.91%, ≙C content of the melt of 3.3% by weight.

S content of the melt=0.035% by weight.

Grain size of the SiC:

untreated: 0–1 mm pre-treated: 0.1–0.5 mm.

In cold crucible: highest grade iron (99.9% by weight Fe), graphite (99.99% by weight C), iron sulphide (>99% by weight FeS).

Heating, smelting and maintenance in an electrically heated crucible furnace under a layer of CO-gas:

1. heating at a rate of 70°–80° C./min up to
2. 1350° C.: stirring or stirring in of the Si carrier for 2 min. and, depending on the example, maintain or
3. further heating at a rate of 50°–60° C./min up to 1500° C.: maintain;
4. cooling of the melt in the crucible at a rate of 25°–30° C./min.

The results are shown in Tables 1–3. As can be seen, the improved preliminary inoculating effect of the SiC pre-treated according to the invention in comparison with untreated SiC is clearly detectable. It is evident in less eutectic supercooling, increase of the number of eutectic granules, an improvement in the separation of graphite in the form of A-graphite and, especially, in a considerable improvement in the tendency to grey hardening.

A commercially available FeSi 75 Ca was included for further comparison.

TABLE 1

Preliminary inoculating effect of pre-treated SiC in comparison with untreated SiC in dependence on the degree of saturation after maintenance at 1500° C. for 10 min; Si-carrier in cold crucible

| Preliminary inoculating effect | Sc = 0.85 untreated SiC | Sc = 0.85 pre-treated SiC | Sc = 0.91 untreated SiC | Sc = 0.91 pre-treated SiC | Sc = 0.96 untreated SiC | Sc = 0.96 pre-treated SiC |
|---|---|---|---|---|---|---|
| Eutectic supercooling ΔT (K) | 17.5 | 5.5 | 12.5 | 2 | 9.5 | 1.5 |
| Number of eutectic granules No. ($cm^{-2}$) | 38 | 74 | 41 | 77 | 40 | 66 |
| Graphite arrangement | | | | | | |
| % A | 20–30 | 30–40 | 40–50 | 50–60 | 50–60 | 60–70 |
| % B | 0 | 0 | 0 | 0 | 0 | ~10 |
| % D | 10–20 | <10 | 10–20 | ~10 | 10–20 | ~10 |
| % E | 50–60 | 60–70 | 40–50 | 30–40 | 30–40 | 10–20 |
| Perlite (vol. %) | 100 | 100 | 100 | 100 | 100 | 100 |
| Ferrite (vol. %) | 0 | 0 | 0 | 0 | 0 | 0 |

TABLE 2

Preliminary inoculating effect of pre-treated SiC in comparison with untreated SiC after maintenance at 1500° C. for 60 min. Si carrier stirred in at 1350° C.

| Preliminary inoculating effect | Untreated SiC | Pre-treated SiC |
|---|---|---|
| eutectic supercooling ΔT (K) | 17.5 | 7.5 |
| Number of eutectic granules No. ($cm^{-2}$) | 4.4 | 29 |
| Graphite arrangement: | | |
| % A | <10 | 20–30 |
| % B | 0 | <5 |
| % D | 50–60 | 20–30 |
| % E | 40–50 | 50–60 |
| Perlite (vol. %) | ~95 | 90–95 |
| Ferrite (vol. %) | ~5 | 10–5 |

TABLE 3

Quench test* for determining the tendency to grey hardening by pre-treated SiC in comparison with untreated SiC and FeSi 75 Ca in dependence on the dwell time at 1500° C. and 1350° C.; Si carrier stirred in at 1350° C.

| Dwell time (min) | Proportion of grey hardening (vol. %) | | |
|---|---|---|---|
| | FeSi 75 Ca** | Untreated SiC | Pre-treated SiC |
| | | 1500° C. | |
| 10 | 0 | 0 | 100 |
| 30 | 0 | 0 | 90 |
| 60 | 0 | 0 | 25–30 |
| 60 | | 1350° C. | 40–50 |
| 120 | | | 20–30 |

*Melt drawn off by means of quartz tube, 14 mm $\phi$, at 1280–1300° C.: maintained for 10 sec. in air then immersed in water.
**72.3% by weight Si; 1.1% by weight Al; 1.1% by weight Ca.

What is claimed is:

1. A process for treating a cast iron melt with silicon carbide which comprises: introducing into the cast iron melt, silicon carbide particles which have been subjected to oxidizing conditions to partially coat the silicon carbide particles with a covering containing silica.

2. The process according to claim 1, wherein the partially coated silicon carbide particles are formed by contacting silicon carbide in particulate form at a temperature of from about 900° C. to about 1600° C. with an oxidizing atmosphere to form agglomerates of silicon carbide, and breaking up the agglomerates to expose the silicon carbide surfaces which were not completely oxidized due to formation of the agglomerates.

3. The process according to claim 1 or 2, wherein the partially coated silicon carbide particles are formed by contacting silicon carbide particles having a particle size not greater than 0.5 mm and a SiC content of at least 95% by weight in a static bed with flowing air, said contacting being carried out at a temperature of from about 1250° to about 1300° C. until said particles agglomerate and a layer of up to 15 $\mu$m of silica is formed on said particles, and separating the agglomerated particles under gentle comminution conditions.

4. The process according to claim 3, wherein said silicon carbide particles have a particle size of from about 0.1 to about 0.5 mm.

5. The process according to claim 3, wherein said silica coating has a thickness of from about 0.5 $\mu$m to about 5 $\mu$m.

6. A process for preparing silicon carbide particles having at least a portion at the surface thereof coated with a silica layer, which comprises contacting silicon carbide particles, at a temperature of from about 900° C. to about 1600° C., with an oxidizing atmosphere to form agglomerates of silicon carbide having a coating of silica, and subjecting said agglomerates to gentle comminution to expose the silicon carbide surfaces which, as a result of the formation of said agglomerates, completely or partially escaped oxidation at the points where said particles were in contact.

7. The process according to claim 6, wherein said silicon carbide particles have a grain size of from about 0.1 to about 0.5 mm.

8. The process according to claim 6, wherein said silica coating has a thickness of from about 0.5 $\mu$m to about 5 $\mu$m.

* * * * *